US009646569B2

(12) United States Patent
Kim et al.

(10) Patent No.: US 9,646,569 B2
(45) Date of Patent: May 9, 2017

(54) METHOD AND APPARATUS FOR CONTROLLING LUMINANCE OF ORGANIC LIGHT EMITTING DIODE DISPLAY DEVICE

(71) Applicant: LG Display Co., Ltd., Seoul (KR)

(72) Inventors: Seong-Gyun Kim, Gunpo-si (KR); Eun-Kyung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 99 days.

(21) Appl. No.: 14/572,517

(22) Filed: Dec. 16, 2014

(65) Prior Publication Data

US 2015/0187331 A1 Jul. 2, 2015

(30) Foreign Application Priority Data

Dec. 30, 2013 (KR) ..... 10-2013-0167065

(51) Int. Cl.
*G09G 3/30* (2006.01)
*G09G 5/10* (2006.01)
(Continued)

(52) U.S. Cl.
CPC ..... *G09G 5/10* (2013.01); *G09G 3/3208* (2013.01); *G09G 3/3291* (2013.01); *G09G 5/02* (2013.01);
(Continued)

(58) Field of Classification Search
CPC ..... G09G 5/10
(Continued)

(56) References Cited

U.S. PATENT DOCUMENTS

2007/0286287 A1 12/2007 Kim et al.
2011/0242149 A1* 10/2011 Yoshida ..... G09G 3/3648 345/690
(Continued)

FOREIGN PATENT DOCUMENTS

CN 1661664 A 8/2005
CN 1987987 A 6/2007
(Continued)

OTHER PUBLICATIONS

Office Action for Chinese Patent Application No. CN 201410858133.2, Nov. 2, 2016, 18 Pages.
(Continued)

*Primary Examiner* — Long D Pham
(74) *Attorney, Agent, or Firm* — Fenwick & West LLP

(57) ABSTRACT

A luminance controller of an OLED device and the OLED device including the luminance controller include a peaking processor for calculating a minimum gray level value by filtering low gray level data from primary RGB data and determining a compensation gain value corresponding to the minimum gray level value; a boosting processor for calculating a maximum gray level value by filtering high gray level data from the primary RGB data, calculating a gain value corresponding to the maximum gray level value, and calculating a coloring ratio coefficient using the minimum gray level value and the maximum gray level value; and a secondary RGB generator for generating secondary RGB data by applying the compensation gain value, the coloring ratio coefficient, and the gain value to the primary RGB data.

10 Claims, 4 Drawing Sheets

(51) Int. Cl.
*G09G 3/3291* (2016.01)
*G09G 5/02* (2006.01)
*G09G 3/3208* (2016.01)

(52) U.S. Cl.
CPC ..... *G09G 2300/0452* (2013.01); *G09G 2320/0271* (2013.01); *G09G 2320/0666* (2013.01); *G09G 2330/021* (2013.01); *G09G 2360/16* (2013.01)

(58) Field of Classification Search
USPC ..... 345/77, 83
See application file for complete search history.

(56) References Cited

U.S. PATENT DOCUMENTS

2013/0342587 A1* 12/2013 Nakagawa ..... G09G 3/20 345/690
2014/0232711 A1* 8/2014 Park ..... G06T 5/003 345/212

FOREIGN PATENT DOCUMENTS

CN 101281713 A 10/2008
EP 1569195 A2 8/2005

OTHER PUBLICATIONS

Image Classification Based on Image Enhancement Methods Based on Classification Image Enhancement Methods Based on Classification Posted on: Dec. 10, 2008, Degree: Master Type: Thesis Country: China Category: Information Technology Candidate, pp. 29-36. (With English Abstrct).

* cited by examiner

METHOD AND APPARATUS FOR CONTROLLING LUMINANCE OF ORGANIC LIGHT EMITTING DIODE DISPLAY DEVICE

CROSS-REFERENCE TO RELATED APPLICATION

This application claims the benefit of Korean Patent Application No. 10-2013-0167065, filed on Dec. 30, 2013, which is hereby incorporated by reference as if fully set forth herein.

BACKGROUND OF THE INVENTION

Field of the Invention

The present disclosure relates to a method and apparatus for controlling luminance of an organic light emitting diode (OLED) display device and, more particularly, to a method and apparatus for controlling luminance of an OLED display device, which are capable of reducing power consumption caused by luminance improvement and outputting an image having high clarity and readability, by controlling luminance of the image in a manner of improving luminance of an achromatic color.

Discussion of the Related Art

An OLED display device is a self-emissive device in which light is emitted from an organic emission layer by recombination of electrons and holes and is expected to be a next-generation display device due to high luminance, low driving voltage, and ultra-thin thickness.

The OLED display device includes a plurality of pixels (subpixels), each of which includes an OLED element and a pixel circuit. The OLED element has an organic light emission layer disposed between an anode and a cathode, and the pixel circuit independently drives the OLED element. The pixel circuit includes a switching transistor, a storage capacitor, and a driving transistor. The switching transistor charges a voltage corresponding to a data signal in the storage capacitor in response to a scan pulse. The driving transistor controls current supplied to the OLED element according to the voltage charged in the storage capacitor to adjust the amount of light emitted from the OLED element. The amount of light emitted from the OLED element is proportional to current supplied by the driving transistor.

The OLED display device uses an RGBW type display device including a white (W) subpixel in addition to red (R), green (G), and blue (B) subpixels, in order to improve luminance and luminous efficiency while maintaining color reproduction. The RGBW OLED display device extracts a gain value using a gray level difference between R, G, and B data, and displays an image using a minimum value of the R, G, and B data as data of W pixel data.

For luminance improvement, such a conventional OLED display device uses a method for improving luminance of an entire display area. Then, power consumption increases due to driving of all subpixels for luminance improvement and thus efficiency degradation occurs, which leads to reduction in lifespan of the OLED element.

In addition, since the conventional OLED display device improves luminance of the entire display area, clarity and readability of a dark image or an image at an edge are degraded.

SUMMARY OF THE INVENTION

Accordingly, the present disclosure is directed to a method and apparatus for controlling luminance of an OLED display device that substantially obviates one or more problems due to limitations and disadvantages of the related art.

An object of the present disclosure is to provide a method and apparatus for controlling luminance of an OLED display device, which are capable of reducing power consumption caused by luminance improvement and outputting an image having high clarity and readability, by controlling luminance of the image in a manner of improving luminance of an achromatic color.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a luminance controller of an OLED display device includes a peaking processor for calculating a minimum gray level value by filtering low gray level data from primary RGB data and determining a compensation gain value corresponding to the minimum gray level value; a boosting processor for calculating a maximum gray level value by filtering high gray level data from the primary RGB data, calculating a gain value corresponding to the maximum gray level value, and calculating a coloring ratio coefficient using the minimum gray level value and the maximum gray level value; and a secondary RGB generator for generating secondary RGB data by applying the compensation gain value, the coloring ratio coefficient, and the gain value to the primary RGB data.

The primary RGB data may be data obtained by categorizing externally input RGB data according to a predetermined window size.

The luminance controller may further include an overflow detector for confirming whether the secondary RGB data overflows.

The peaking processor may include a first filter having a band-pass filter for calculating the minimum gray level value by filtering the low gray level data and a peaker for determining the compensation gain value for the minimum gray level value.

The boosting processor may include a coloring ratio coefficient calculator for calculating the coloring ratio coefficient by dividing the minimum gray level value by the maximum gray level value, a second filter having a high pass filter for calculating the maximum gray level value, and a booster for determining the gain value for the maximum gray level value.

In another aspect of the present disclosure, a luminance control method includes calculating a minimum gray level value by filtering low gray level data from primary RGB data; determining a compensation gain value corresponding to the minimum gray level value; calculating a maximum gray level value by filtering high gray level data from the primary RGB data; calculating a gain value corresponding to the maximum gray level value; calculating a coloring ratio coefficient using the minimum gray level value and using the maximum gray level value; and calculating secondary RGB data by applying the compensation gain value, the coloring ratio coefficient, and the gain value to the primary RGB data.

The luminance control method may further include generating the primary RGB data by categorizing externally input RGB data according to a predetermined window size.

The luminance control method may further include confirming whether the secondary RGB data overflows.

The calculating the minimum gray level value or the calculating the maximum gray level value may include performing band-pass filtering for calculating the minimum gray level value or performing high pass filtering for calculating the maximum gray level value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
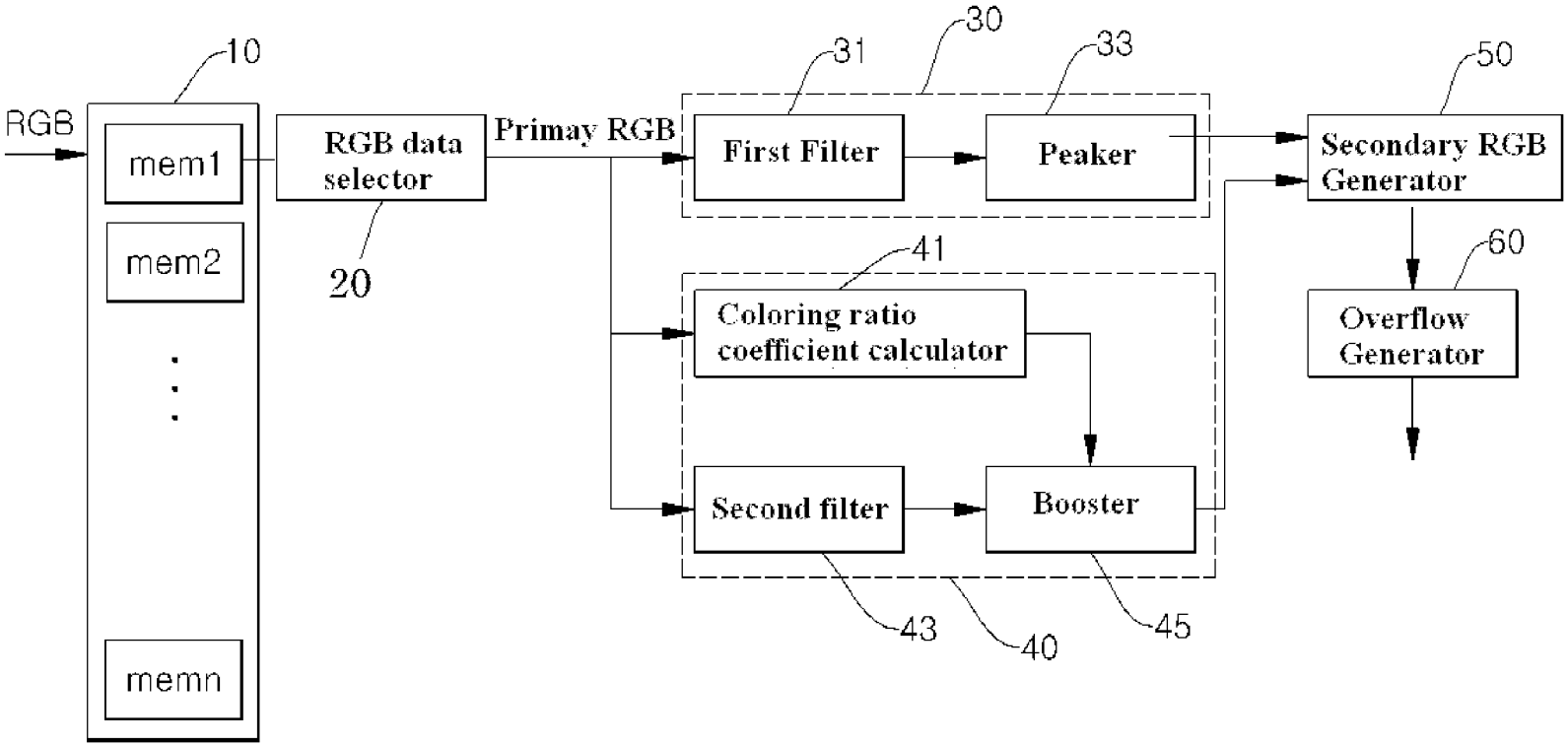
FIG. 1 is a diagram exemplarily showing the configuration of a luminance controller according to one embodiment.

Hereinafter, exemplary embodiments will be described with reference to the accompanying drawings. In the drawings, it should be noted that the same or similar elements are denoted by the same reference numerals even though they are depicted in different drawings. Further, in the following description, a detailed description of known functions and configurations incorporated herein will be omitted when it may make the subject matter of the present invention unclear. Those skilled in the art can easily understand that specific features shown in the drawings are enlarged, reduced, or simplified for easier understanding, and not all components are shown to scale in the drawings.

FIG. 1 is a diagram exemplarily showing the configuration of a luminance controller according to one embodiment.

Referring to FIG. 1, the luminance controller according to one embodiment includes an image storage 10, an RGB data selector 20, a peaking processor 30, a boosting processor 40, a secondary RGB generator 50, and an overflow detector 60.

The image storage 10 separately stores an image input from the exterior in the unit of windows to be processed in the peaking processor 30 and the boosting processor 40, and provides a plurality of RGB data of the unit of window to the RGB data selector 20. The image stored in the image storage 10 may be digital RGB data. That is, the primary RGB data is data obtained by categorizing externally input RGB data according to a predetermined window size.

The RGB data selector 20 selects RGB data for which luminance control is to be performed from the plurality of RGB data stored in the image storage 10, and provides the selected RGB data to the peaking processor 30 and the boosting processor 40. When the peaking processor 30 and the boosting processor 40 require forms of data other than the digital RGB data, for example, data in the form of YUV which is a digital color difference signal including a luminance component, the RGB data selector 20 may convert digital RGB data into a signal format needed in the peaking processor 30 and the boosting processor 40, and transmit the converted signal to the peaking processor 30 and the boosting processor 40. Hereinafter, the digital RGB data will be referred to as "primary RGB data" irrespective of conversion, for convenience of description.

The peaking processor 30 performs peaking processing for an edge component of the primary RGB data in order to increase clarity (or sharpness) of an image. Here, the edge refers to pixels which the gray levels are sharply changed, and peaking processing refers to improving the clarity of the edge through edge compensation in a manner of lightening a bright part of neighbor pixels of the edge by increasing luminance, and darkening a dark part of neighbor pixels of the edge by lowering luminance. In particular, the peaking processor 30 serves to improve clarity lowered by lightening the image of a dark part among images in the case in which luminance of an image is improved by the boosting processor 40. In other words, when luminance of an image is increased by the boosting processor 40, the peaking processor 30 increases a luminance difference between a lightened part and a darkened part by suppressing or lowering a luminance increase of the dark part, thereby increasing clarity and sharpness of an image.

The peaking processor 30 extracts RGB data having a low gray level from the primary RGB data, calculates a compensation gain value AK for the RGB data having the low gray level, and transmits the compensation gain value AK to the secondary RGB generator 50. To this end, the peaking processor 30 includes a first filter 31 and a peaker 33.

The first filter 31 extracts a low gray level value from high-frequency components extracted from the primary RGB data and transmits the low gray level value to the peaker 33. The first filter 31 may be configured by a band-pass filter (BPF). As an example, the first filter extracts the lowest minimum gray level value MIN from four R, G, B, and W subpixels of a window constituting the primary RGB data and transmits the lowest minimum gray level value to the peaker 33. The filtering width of the BPF may be experimentally determined and calculated.

The peaker 33 calculates a low gray level gain to increase the clarity and sharpness of an image by lowering luminance of a part having a low gray level. More specifically, the peaker 33 calculates a frequency component calculated by using the first filter 31, i.e., a minimum gray level value MIN, to compute a first compensation gain value AK for compensating for a low gray level. The compensation gain value AK is transmitted to the secondary RGB generator 50, and is used as a gain value for compensating for the low gray level in generating secondary RGB data. To this end, the peaker 33 prestores a predetermined linear equation for calculating the compensation gain value AK and calculates the compensation gain value AK by substituting the minimum gray level value MIN for the linear equation. In this process, the compensation gain value AK is determined as a value between a maximum compensation gain value AKMAX and a minimum compensation gain value AKMIN. If the compensation gain value AK exceeds the maximum compensation gain value AKMAX, the compensation gain value AK is determined as the maximum compensation gain value AKMAX and if the compensation gain value AK is less than the minimum compensation gain value AKMIN, the compensation gain value AK is determined as the minimum compensation gain value AKMIN. The determined compensation gain value is transmitted to the secondary RGB generator 50. In order to calculate the compensation gain value AK, the peaker 33 may receive a coloring ratio coefficient CR from a coloring ratio coefficient calculator 41 or a gain value K from a booster 45, but the present disclosure is not limited thereto. The peaker 33 extracts the minimum gray level value MIN to calculate the compensation gain value AK, which is a gain for compensating for a dark image included in a window, and restricts increase in luminance of the dark image using the compensation gain value AK, thereby raising the clarity and sharpness of an edge part.

The boosting processor 40 calculates a gain value K for increasing luminance of the primary RGB data and transmits the calculated gain value K to the secondary RGB generator 50. More specifically, the boosting processor 40 analyzes high-frequency components of the primary RGB data and detects an achromatic color and an edge part among the high-frequency components to improve luminance at an edge area. To this end, the boosting processor 40 includes a coloring ratio coefficient calculator 41, a second filter 43, and a booster 45.

The coloring ratio coefficient calculator 41 calculates a coloring ratio coefficient CR for calculating an achromatic ratio from the primary RGB data. The coloring ratio coefficient calculator 41 calculates the coloring ratio coefficient CR using the minimum gray level value MIN and the maximum gray level value MAX of the primary RGB data and transmits the calculated coloring ratio coefficient CR to the secondary RGB generator 50. The coloring ratio coefficient calculator 41 divides the minimum gray level value MIN by the maximum gray level value MAX of data included in each window of the primary RGB data to calculate the coloring ratio coefficient CR. The coloring ratio coefficient CR is a coefficient capable of checking the ratio of an achromatic color by confirming whether chroma is high or low. More specifically, if an image expressed in each window is mainly based on a specific color, for example, R, the gray level value of R increases, whereas the gray level values of G and B decrease. Therefore, the value of the calculated coloring ratio coefficient CR based on this case approximates to 0. Meanwhile, in the case of an achromatic color, since the gray level values of R, G, and B are similar to each other, the value of the coloring ratio coefficient CR approximates to 1. The coloring ratio coefficient CR is used as a gain for generating the secondary RGB data and enables luminance of data including many achromatic colors to have a higher gain value than luminance of data which does not include many achromatic colors.

The second filter 43 extracts the maximum gray level value MAX from the primary RGB data and provides the extracted maximum gray level value MAX to the booster 45. The second filter 43 may be configured by a high-pass filter (HPF). The second filter 43 extracts the maximum gray level value MAX which is the highest gray level value of subpixel data constituting the window of the primary RGB data and transmits the extracted value to the booster 45. The filtering range of the HPF may be experimentally determined and calculated. The second filter 43 may filter a high-frequency component among luminance components of the primary RGB data. The booster 45 uses the high-frequency components filtered by the second filter 43 as an edge detection value. The second filter 43 may use a spatial filter such as a Roberts filter, a Prewitt filter, or a Sobel filter but the present invention is not limited thereto.

The booster 45 calculates the gain value K for raising luminance of an image using the maximum gray level value MAX transmitted by the second filter 43. More specifically, the booster 45 prestores a predetermined linear equation for calculating the gain value K and calculates the gain value K by applying the maximum gray level value MAX to the linear equation. In this case, the linear equation set for the booster 45 and the linear equation set for the peaker 33 may be equal except for constants used in the equations but the present invention is not restricted thereto. The gain value K is determined as a value between a maximum gain value KMAX and a minimum gain value KMIN. If the gain value K, obtained by applying the maximum gray level value MAX to a linear equation, is greater than the maximum gain value KMAX or less than the minimum gain value KMIN, the gain value K is determined as the maximum gain value KMAX or the minimum gain value KMIN. The booster 45 transmits the determined gain value K to the secondary RGB generator 50.

Meanwhile, the booster 45 may detect an edge area by comparing a value of the filtered high-frequency component or the maximum gray level value MAX with a predetermined threshold. That is, the booster 45 may detect the edge area of the primary RGB data and calculate the gain value K for the detected edge area. To this end, the booster 45 compares the predetermined threshold with the value of the filtered high-frequency component or the maximum gray level value MAX to determine whether the value of the filtered high-frequency component or the maximum gray level value MAX is greater than the threshold. If the value of the filtered high-frequency component or the maximum gray level value MAX is greater than the threshold, the booster 45 may determine that a corresponding area is the edge area and determine the gain value K for the edge area. To determine the gain value K, an equation other than a linear equation may be further used but the present invention is not limited thereto.

The secondary RGB generator 50 applies the values calculated by the peaking processor 30 and the boosting processor 40 to the primary RGB data to calculate secondary RGB data to which a gain is applied. More specifically, the secondary RGB generator 50 calculates a final gain value KF through a multiplication operation for the first compensation gain value AK, the coloring ratio coefficient CR, and the gain value K, calculated with respect to the primary RGB data, and calculates the secondary RGB data by applying the calculated gain value KF to the primary RGB data.

The overflow detector 60 confirms whether the secondary RGB data overflows and outputs the second RGB data depending upon whether the secondary RGB data overflows. To this end, the overflow detector 60 confirms whether luminance of the secondary RGB data exceeds a maximum luminance value of RGB. If luminance of the secondary RGB data exceeds the maximum luminance value of RGB, the overflow detector 60 determines that the secondary RGB data overflows and, if it is less than the maximum luminance value, the overflow detector 60 determines that the secondary RGB underflows. The overflow detector 60 outputs the secondary RGB data of overflow and the secondary RGB data of underflow.

Figure 2A:
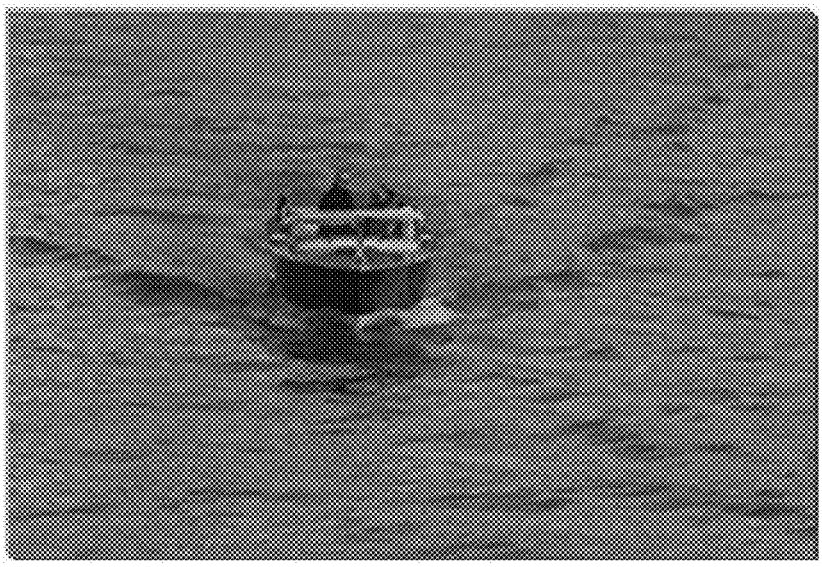
FIGS. 2A and 2B are diagrams for exemplarily explaining image processing by the luminance controller of FIG. 1.
Figure 2B:
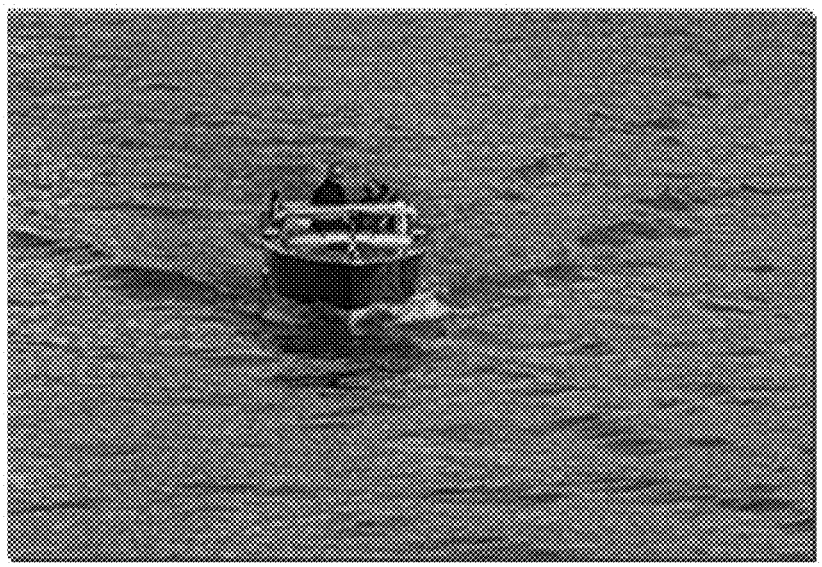

FIGS. 2A and 2B are diagrams for exemplarily explaining image processing by the luminance controller of FIG. 1.

Referring to FIGS. 2A and 2B, FIG. 2A shows an image output through conventional image processing. In conventional image processing, since luminance of an entire screen is improved, luminance is increased throughout an entire image and a bright image can be output.

However, in such conventional image processing, since luminance of a dark area is increased together with luminance of a bright area, an edge part is not distinctly distinguished from the other parts and thus clarity is lowered. Accordingly, ripples in FIG. 2A are not clearly distinguished as compared with FIG. 2B and the clarity of the image is lowered as can be seen from a ship in the center of the image.

In contrast, in FIG. 2B, the ripples are clearly expressed relative to FIG. 2A and the clarity of the ship is increased. Thus, the present invention mainly improves an edge part in improving the overall luminance of an image. Especially, in enhancing luminance, increase in luminance of a dark part is restricted to contrast with improvement of luminance of a bright part so that clarity is increased. In addition, an edge part is detected and luminance of an image is improved mainly focusing upon the edge part. Then the sharpness of the edge part is increased and a delicate image can be provided even when luminance of the image is raised.

Figure 3:
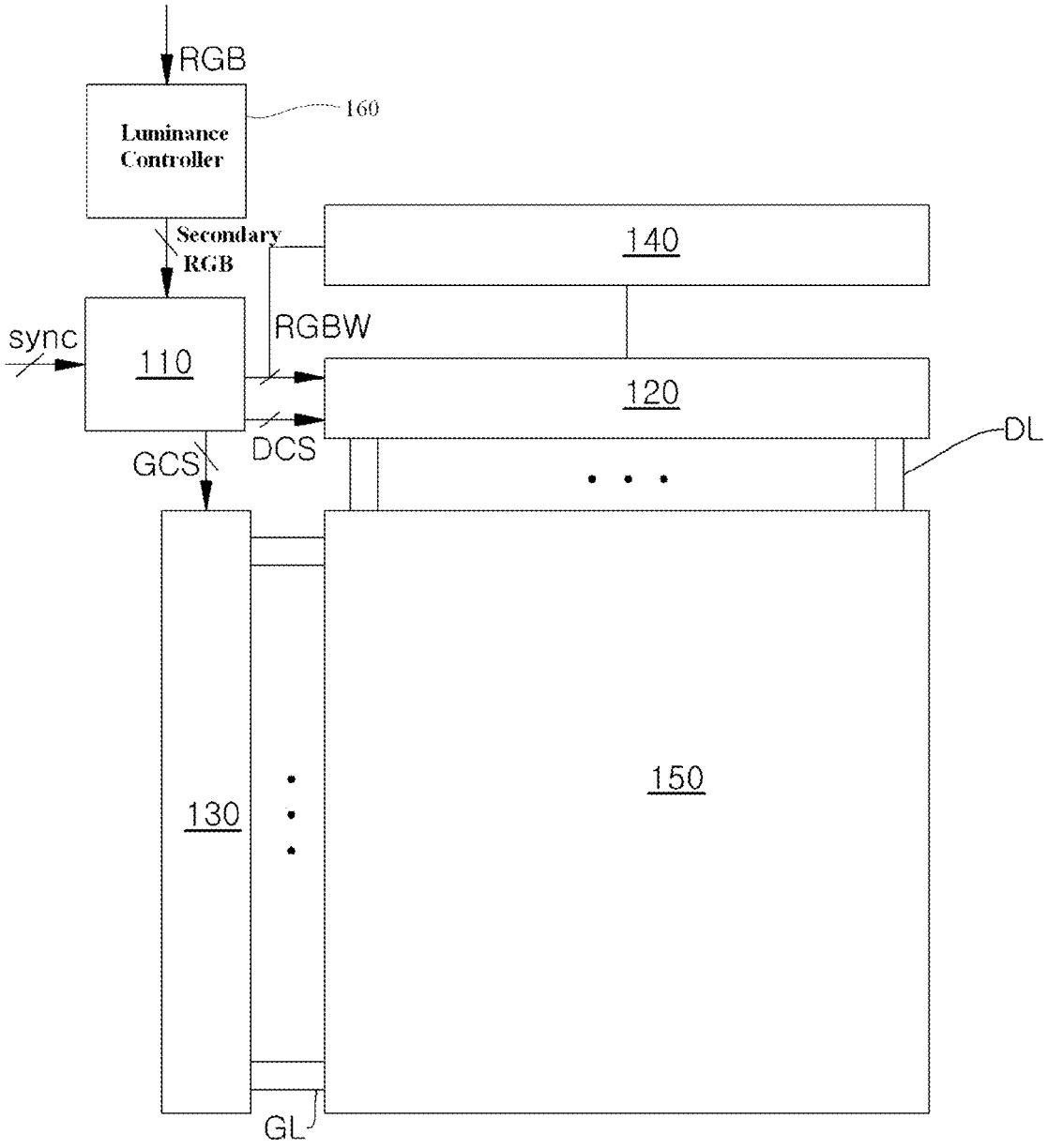
FIG. 3 is a block diagram schematically showing an OLED display device to which the luminance controller of FIG. 1 is applied.

FIG. 3 is a block diagram schematically showing an OLED display device to which the luminance controller of FIG. 1 is applied.

Referring to FIG. 3, the OLED display device includes a timing controller 110, a data driver 120, a gate driver 130, a gamma voltage generator 140, a display panel 150, and a luminance controller 160.

The luminance controller 160 determines luminance according to characteristic of an image supplied from the exterior and provides a secondary RGB signal generated according to the determined luminance to the gamma voltage generator 140. The luminance controller 160 may use the luminance controller described with reference to FIG. 1 but the present invention is not limited thereto.

More specifically, the luminance controller 160 categorizes primary RGB data, which is RGB data supplied from the timing controller 110, in the units of windows, and generates secondary RGB data by performing peaking processing and boosting processing on the primary RGB data categorized in the unit of windows. The luminance controller 160 confirms whether the secondary RGB data overflows and transmits the overflow-distinguished secondary RGB data to the gamma voltage generator 140. To this end, the luminance controller 160 includes the boosting processor 40 and the peaking processor 30.

As described above, the boosting processor 40 extracts the maximum gray level value MAX from primary RGB data components to determine the gain value K with respect to the maximum gray level value MAX and detects an edge area by extracting a high-frequency component from luminance components. The boosting processor 40 calculates the coloring ratio coefficient CR and transmits the calculated coloring ratio coefficient and the gain value K to the secondary RGB generator 50. In addition, the peaking processor 30 extracts the minimum gray level value MIN from the primary RGB data, determines the compensation gain value AK for the minimum gray level value MIN, and transmits the compensation gain value AK to the secondary RGB generator 50.

The secondary RGB generator 50 calculates the secondary RGB data by applying the gain value K, the coloring ratio coefficient CR, and the compensation gain value AK to the primary RGB data and transmits the calculated secondary RGB data to the overflow detector 60. The overflow detector 60 detects overflow of the secondary RGB data and transmits the secondary RGB data including overflow information to the gamma voltage generator 140.

The timing controller 110 converts the secondary RGB data supplied from the luminance controller 60 into RGBW data and provides the converted RGBW data to the gamma voltage generator 140 and the data driver 120. In this case, luminance of an image can be enhanced by overflow according to the present invention. In more detail, a gray level greater than a maximum gray level expressed by RGB is expressed by driving of a W subpixel to express higher luminance. Luminance higher than luminance of a gray level expressed by RGB is defined as overflow. The timing controller 110 generates a gamma voltage corresponding to RGB and a gamma voltage corresponding to W by applying the secondary RGB data to a predetermined equation or a lookup table. Especially, the equation or the lookup table may vary according to overflow or non-overflow but the present invention is not restricted thereto. The timing controller 110 generates a data control signal DCS and a gate control signal GCS for controlling the driving times of the data driver 120 and the gate driver 130, respectively, according to an external synchronization signal sync.

The gamma voltage generator 140 generates a gamma voltage set including a plurality of gamma voltages having different levels corresponding to the RGBW data supplied from the timing controller 110 and transmits the gamma voltage set to the data driver 120. Especially, the gamma voltage generator 140 generates the gamma voltage for driving the W subpixel according to an overflow state transmitted by the luminance controller 160.

The data driver 120 converts the RGBW data supplied from the timing controller 110 into an analog image signal according to the data control signal DCS supplied from the timing controller 110 and transmits the image signal to data lines DL one horizontal line by one horizontal line every horizontal period at which a gate-ON voltage is supplied to gate lines GL. The data driver 120 divides the gamma voltage set generated from the gamma voltage generator 140 into gray level voltages corresponding respectively to gray level values of data and converts the digital RGBW data into an analog data signal using the divided gray level voltages.

The gate driver 130 sequentially drives the gate lines GL of the display panel 150 in response to the gate control signal GCS generated from the timing controller 110. The gate driver 130 supplies a scan pulse of a gate-ON voltage during a scan duration of each gate line GL in response to the gate control signal GCS and supplies a gate-OFF voltage during the other durations.

The display panel 150 forms the data line DL and the gate line GL to define a subpixel area. In the subpixel area, R, G, B, and W subpixels are repeatedly formed in the direction of a row. Color filters corresponding to R, G, and B are arranged in the R, G, and B subpixels, respectively, whereas a color filter may not be arranged in the W subpixel. However, the present invention is not limited thereto. Each subpixel of the display panel 150 includes an OLED element and a pixel circuit for driving the OLED element. The pixel circuit may include a switching transistor, a driving transistor, and a storage capacitor. The switching transistor charges a voltage corresponding to a data signal supplied from the data line DL in the storage capacitor in response to a scan pulse supplied from the gate line GL. The driving transistor adjusts the amount of light emitted from the OLED element by controlling current supplied to the OLED element according to the voltage charged in the storage capacitor. The amount of light emitted from the OLED element is proportional to current supplied from the driving transistor.

Figure 4:
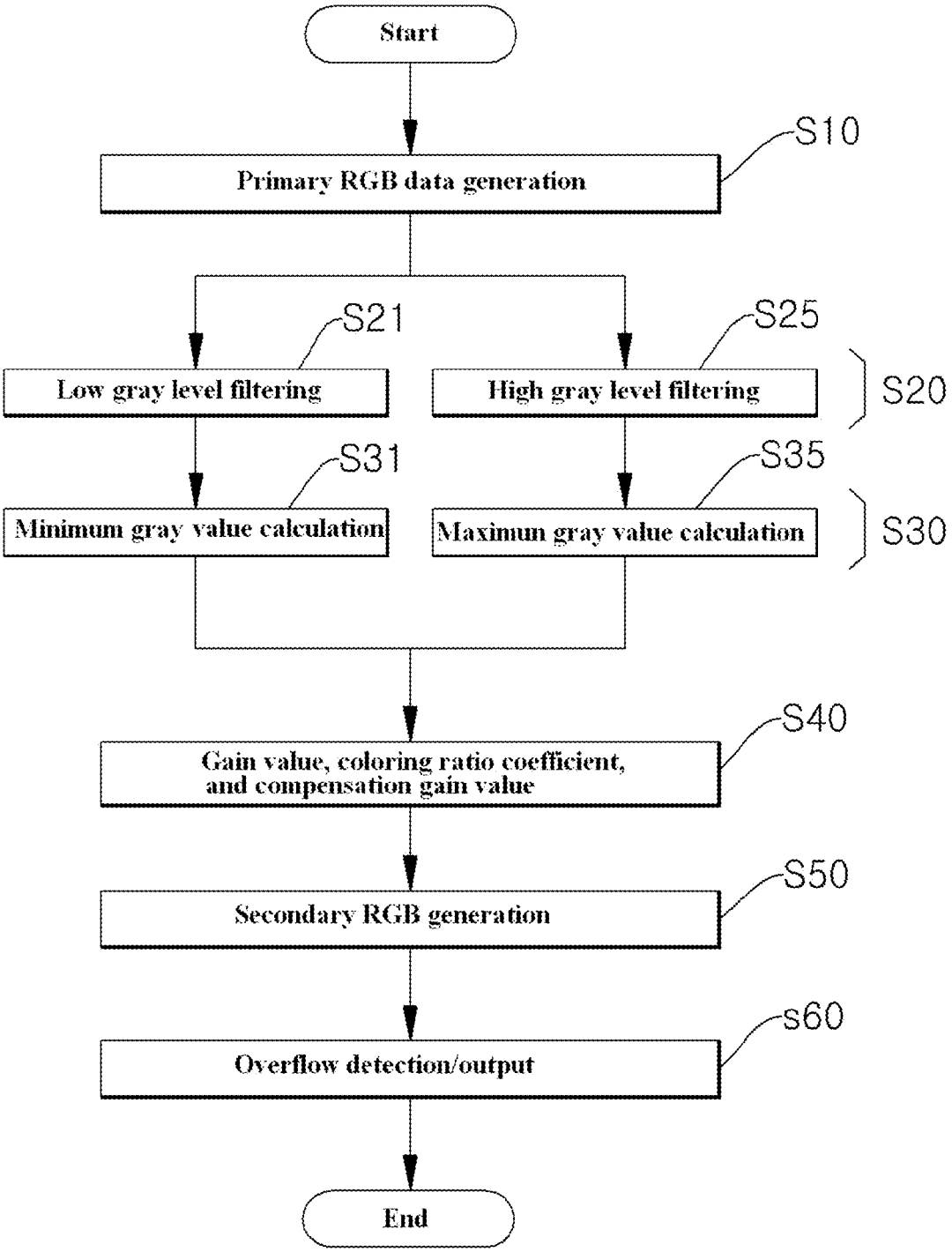
FIG. 4 is a flowchart for explaining a luminance control method according to one embodiment.

FIG. 4 is a flowchart for explaining a luminance control method according to the present invention. Referring to FIG. 4, the luminance control method according to the present invention includes a primary RGB data generation step S10, a filtering step S20, a gray level value calculation step S30, a gain value, coloring ratio coefficient, and compensation gain value calculation step S40, a secondary RGB generation step S50, and an overflow detection and output step S60.

In the primary RGB data generation step S10, primary RGB data is generated using RGB data input from the exterior. In the primary RGB data generation step S10, the input RGB data is categorized according to a predetermined window size to generate primary RGB data and the generated primary RGB data may be stored in a frame memory according to a window. Each window may include one RGB subpixel or a plurality of RGB subpixels.

The filtering step S20 serves to filter a desired gray level value and a high-frequency component by filtering the primary RGB data. The filtering step S20 includes a low gray level filtering step S21 and a high gray level filtering step S25.

In the low gray level filtering step S21, the primary RGB data is filtered using a band pass filter (BPF). In the high gray level filtering step S25, the primary RGB data is filtered using a high pass filter (HPF).

In the gray level value calculation step S30, a minimum gray level value MIN is calculated using the filtered result of the low gray level filtering step S21 and a maximum gray level value MAX is calculated using the filtered result of the high gray level filtering step S25.

The gain value, coloring ratio coefficient, and compensation gain value calculation step S40 serves to calculate a gain value K, a coloring ratio coefficient CR, and a compensation gain value AK, using the minimum gray level value MIN and the maximum gray level value MAX. The gain value K and the compensation gain value AK are calculated by applying the minimum gray level value MIN and the maximum gray level value MAX to linear equations for calculating the gain value K and the compensation gain value AK. The coloring ratio coefficient CR indicating the ratio of an achromatic color is calculated by dividing the minimum gray level value MIN by the maximum gray level value MAX.

In the secondary RGB generation step S50, the gain value K, the compensation gain value AK, and the coloring ratio coefficient CR as gains are multiplied, and then are applied to the primary RGB data to generate the secondary RGB data. In the secondary RGB generation step S50, the gain value K, which is a gain for a high gray level, the compensation gain value AK, which is a gain for a low gray level, and the ratio of the achromatic color are used as the gains for the primary RGB data. Therefore, the gains reflecting the high gray level, the low gray level, and the ratio of the achromatic color for adjusting luminance of the high and low gray levels are calculated and the secondary RGB data according to the calculated gains is calculated.

In the overflow detection output step S60, it is checked whether the secondary RGB data overflows and the secondary RGB data including overflow information is output.

The secondary RGB data is converted into RGBW data in the display device and the RGBW data into which overflow which is capable of being expressed by a W subpixel is reflected is output. This has been described in the foregoing and therefore a detailed description thereof will be omitted.

As described above, the method and apparatus for controlling luminance of an OLED display device can reduce dissipated power caused by luminance improvement and output an image having high clarity and readability, by controlling luminance of the image in a manner of improving luminance of an achromatic color.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A luminance controller, comprising:

a peaking processor for calculating a minimum gray level value from a band pass filtered version of primary RGB data, wherein the minimum gray level value is a lowest gray level value from the band pass filtered version of the primary RGB data, and determining a compensation gain value corresponding to the minimum gray level value;

a boosting processor for calculating a maximum gray level value from a high pass filtered version of the primary RGB data, wherein the maximum gray level value is a highest gray level value from the high pass filtered version of the primary RGB data, calculating a gain value corresponding to the maximum gray level value, and calculating a coloring ratio coefficient representing a ratio between the minimum gray level value and the maximum gray level value; and a secondary RGB generator for generating secondary RGB data by applying the compensation gain value, the coloring ratio coefficient, and the gain value to the primary RGB data.

2. The luminance controller according to claim 1, wherein the primary RGB data is data obtained by categorizing externally input RGB data according to a predetermined window size.

3. The luminance controller according to claim 1, further comprising an overflow detector for confirming whether the secondary RGB data overflows.

4. The luminance controller according to claim 1, wherein the peaking processor includes:

a first filter having a band-pass filter for filtering the primary RGB data to generate the band pass filtered version of the primary RGB data; and a peaker for determining the compensation gain value for the minimum gray level value.

5. The luminance controller according to claim 1, wherein the boosting processor includes:

a coloring ratio coefficient calculator for calculating the coloring ratio coefficient by dividing the minimum gray level value by the maximum gray level value;

a second filter having a high pass filter for filtering the primary RGB data to generate the high pass filtered version of the primary RGB data; and a booster for determining the gain value for the maximum gray level value.

6. An organic light emitting diode (OLED) display device including a luminance controller, the luminance controller comprising:

a peaking processor for calculating a minimum gray level value from a band pass filtered version of primary RGB data, wherein the minimum gray level value is a lowest gray level value from the band pass filtered version of the primary RGB data, and determining a compensation gain value corresponding to the minimum gray level value;

a boosting processor for calculating a maximum gray level value from a high pass filtered version of the primary RGB data, wherein the maximum gray level value is a highest gray level value from the high pass filtered version of the primary RGB data, calculating a gain value corresponding to the maximum gray level value, and calculating a coloring ratio coefficient representing a ratio between the minimum gray level value and the maximum gray level value; and a secondary RGB generator for generating secondary RGB data by applying the compensation gain value, the coloring ratio coefficient, and the gain value to the primary RGB data.

7. A luminance control method, comprising:

calculating a minimum gray level value from a band pass filtered version of primary RGB data, wherein the minimum gray level value is a lowest gray level value from the band pass filtered version of the primary RGB data;

determining a compensation gain value corresponding to the minimum gray level value;

calculating a maximum gray level value from a high pass filtered version of the primary RGB data, wherein the maximum gray level value is a highest gray level value from the high pass filtered version of the primary RGB data;

calculating a gain value corresponding to the maximum gray level value;

calculating a coloring ratio coefficient representing a ratio between the minimum gray level value and the maximum gray level value; and calculating secondary RGB data by applying the compensation gain value, the coloring ratio coefficient, and the gain value to the primary RGB data.

8. The luminance control method according to claim 7, further comprising generating the primary RGB data by categorizing externally input RGB data according to a predetermined window size.

9. The luminance control method according to claim 7, further comprising confirming whether the secondary RGB data overflows.

10. The luminance control method according to claim 7, wherein the calculating the minimum gray level value or the calculating the maximum gray level value includes filtering the primary RGB data with a band pass filter to generate the band pass filtered version of the primary RGB data or filtering the primary RGB data with a high pass filter to generate the high pass filtered version of the primary RGB data.

* * * * *